United States Patent [19]

Nadolink

[11] Patent Number: 4,987,844

[45] Date of Patent: Jan. 29, 1991

[54] SYSTEM FOR REDUCING DRAG AND NOISE OF UNDERWATER VEHICLES

[75] Inventor: Richard H. Nadolink, Portsmouth, R.I.

[73] Assignee: The United States of America as represented by the Secretary of the Navy, Washington, D.C.

[21] Appl. No.: 116,284

[22] Filed: Feb. 17, 1971

[51] Int. Cl.[5] ..... F42G 19/00

[52] U.S. Cl. ..... 114/20.1; 114/67 A; 114/234; 252/62

[58] Field of Search ..... 106/311; 252/62; 117/122; 114/234, 20 R, 20.1, 67 A; 115/0.5

[56] References Cited

U.S. PATENT DOCUMENTS

| | | | |
|---|---|---|---|
| 3,196,823 | 7/1965 | Thurston | 114/20 R X |
| 3,230,919 | 1/1966 | Crawford | 114/67 |
| 3,382,831 | 5/1968 | Madison | 114/20 R |
| 3,382,832 | 5/1968 | Swanson | 114/20 R |
| 3,392,693 | 7/1968 | Hubsebos et al. | 114/20 R |
| 3,435,796 | 4/1969 | Merrill | 114/20 R X |
| 4,186,679 | 2/1980 | Fabula et al. | 114/20.1 |

*Primary Examiner*—Stephen J. Lechert, Jr.
*Attorney, Agent, or Firm*—Michael J. McGowan; Prithvi Lall

[57] ABSTRACT

A means and method for simultaneously reducing drag and noise of a high-speed underwater vehicle is provided. Water is admitted through a water intake scoop in the nose of the vehicle and a polymer powder-gas combination is injected into the water stream in the scoop. The water, polymer and gas are mixed in a mixing chamber into which the scoop empties and are ejected through a circumferential ejector disposed at the minimum pressure point.

6 Claims, 1 Drawing Sheet

SYSTEM FOR REDUCING DRAG AND NOISE OF UNDERWATER VEHICLES

The invention described herein may be manufactured and used by or for the Government of the United States of America for governmental purposes without the payment of any royalties thereon or therefor.

This invention concerns drag and noise reduction techniques and, more particularly, a single method and means for simultaneously reducing drag and noise of both low- and high-speed underwater vehicles.

Drag and noise reduction through the use of various types of polymers ejected in the boundary layer of underwater vehicles have been accomplished with varying degrees of success up to the present time. Noise reduction through the use of bubbles in a screen about the hull to be protected also has been attempted with some success. However, no known apparatus for accomplishing both drag reduction and noise reduction is available nor contemplated to the knowledge of the inventor. A strong need thus exists for a single device which will through common orifices, mixing chambers, etc., produce an aqueous-polymer-gas combination which may be efficiently ejected and which will appreciably reduce both drag and noise emanating from the vehicle due to both flow and radiated components of the noise.

The present invention provides a combination of dilute aqueous polymer solution and gas mixture which may be efficiently ejected into the leading portion of the boundary layer of an underwater vehicle to supply this wall layer with a polymer + water + gas bubble environment in order to reduce the drag and noise of underwater vehicles, including torpedoes. A water intake scoop located at the stagnation point of the nose of the vehicle admits a stream of ambient water at pressures equivalent to the vehicle's dynamic head. Injected into the throat of the scoop is a polymer powder-gas combination which is mixed with the water in the scoop and subsequently in a chamber adjacent to the end of the scoop to form an aqueous solution of polymer and water in a field of gas bubbles. The polymer powder is suspended in a liquid carrier disposed in a pressure vessel in the chamber. The liquid carrier may be Freon-12 and the powder may be a substance such as polyox powder which, when combined and exposed to ambient pressure in the throat, is forced to change phase. The powder, because of its pre-wetted condition, in effect, "explodes" into an infinite number of kernels, effectively exposing many times the available wetting area and thus greatly reducing the hydration time of the powder. The combination generally of the carrier liquid and suitable basic polymer formulas produces an aqueous solution of polymer and water in a field of gas bubbles which solution is ejected into the boundary layer of the nose of the vehicle through a suitable ejection device.

Accordingly, it is an object of the present invention to simultaneously reduce the drag and noise of an underwater vehicle by ejecting into the boundary layer thereof a combination of dilute polymer solution and gas mixture.

Another object of this invention is to reduce the drag and noise of an underwater vehicle by combining in the vehicle and ejecting into the boundary layer a carrier liquid and a basic polymer formula.

A further object of the invention is to provide a means for and method of dispensing a polymer solution-gas mixture into the boundary layer of underwater vehicles wherein the gas mixture is obtained from a powder initially stored in the nose of the vehicle.

Other objects, advantages and novel features of the invention will become apparent from the following detailed description thereof when considered in conjunction with the accompanying drawing wherein.

Figure 1:
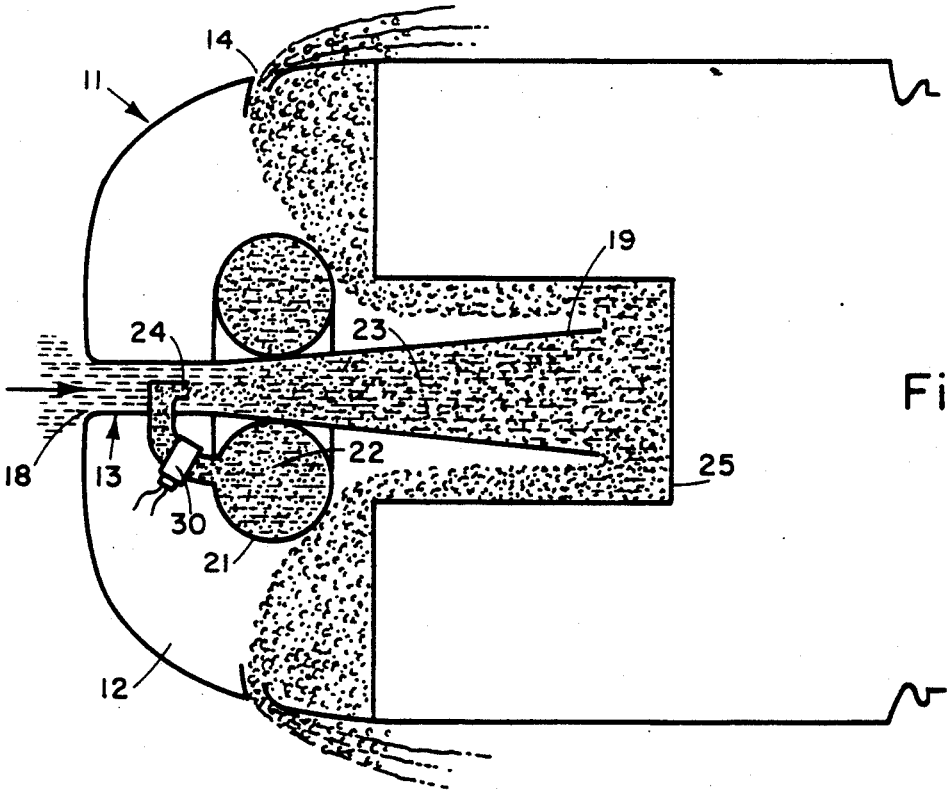
FIG. 1 is a schematic diagram of one embodiment of the invention.

Referring to FIG. 1, there is shown schematically an underwater vessel such as a torpedo 11 having a nose section 12 which is provided with a passage 13 positioned at the stagnation point of nose 12 and a circumferential ejection slot 14 which is positioned at the minimum pressure point of the nose of the torpedo. Passage 13 may be formed as shown to provide a tapered water intake scoop having a narrow orifice 18 and a substantially wider discharge outlet 19. Installed within nose 12 is a storage vessel or bladder 21 which may be toroidal in form as shown so that it may be positioned about water intake scoop 13. Vessel 21 in the present embodiment is not provided with a supply line; however, it will be appreciated that the material to be carried in vessel 21 such as a polymer concentrate may be conducted from a remote supply source to replenish the supply in the vessel.

A polymer concentrate 22 is contained in vessel 21 and is introduced into the stream of water 23 which enters through scoop 18 in an aspirator-type ejector 24 disposed selectively in the narrow part of scoop 18. Scoop 18 terminates within a diffuser 25 which is selectively tapered so as to most efficiently mix the water entering scoop 18 and polymer concentrate 22, the resulting combination containing a substantially infinite number of particles or "kernels" in one type of polymer concentrate which have the capability of exploding into many more kernels to provide a greatly enlarged wetting area and a resultant rapid gas formation. The combined water and concentrate fills chamber 12 and thereafter is forced out of the chamber through slot 14 into the boundary layer about the torpedo. Concentrate 22 preferably contains both a carrier liquid such as Freon-12 and a polyox powder which has the aforementioned capability of "exploding", effectively exposing a greatly increasing wetting area and thereby greatly decreasing the hydration time necessary to dissolve the polyox powder. Rapid dissolution is further enhanced by the use of a carrier liquid having a high vapor pressure and a susceptibility to being forced to change phase. Such mixing produces a combined gas + water + polymer mix forming the desired aqueous solution of polymer and water in a field of gas bubbles.

Toroidal vessel 21 is shown in the preferred position for storing the liquid carrier and polymer powder in suspension form at an ambient pressure equivalent to the vapor pressure of the liquid carrier. Additional carrier liquid and polyox powder may be supplied from tanks in the interior of the vehicle. The vapor pressure of the carrier liquid in toroidal vessel 21 must be sufficiently high to charge and drive the expulsion system. That is, the vapor pressure must be high enough to overcome ambient pressure under ambient temperature conditions plus pressure losses in the transfer line to the mixing chamber. A void necessarily is maintained over the liquid carrier. A control and metering valve 30 preferably is installed in the supply line from vessel 21 to scoop 13 to vary the supply of polymer/carrier liquid being delivered to the ejector.

Boundary layer ejection is accomplished at the point of minimum pressure coefficient of the nose of the underwater vehicle. The ejection apparatus may be either screening, mesh, a porous media, perforated material, drilled holes of specific geometry, a circumferential slot, etc., in order to shape the polymer/water solution+gas products to an optimum bubble configuration and geometry density for introduction into the boundary layer.

Figure 2:
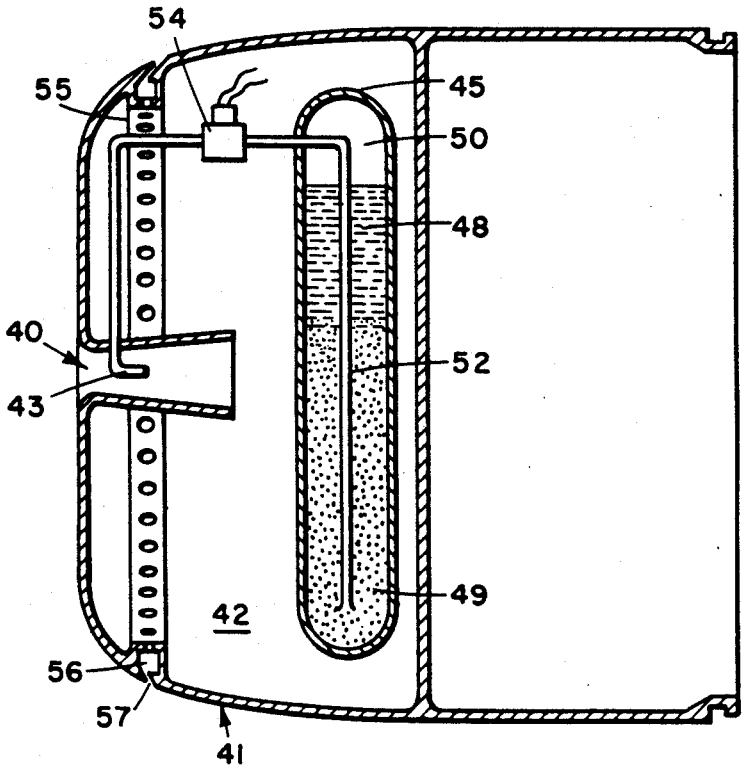
FIG. 2 is a schematic diagram of a second embodiment of the invention.

In FIG. 2, a specific embodiment for accomplishing the invention is illustrated which includes a water scoop 40 positioned at the stagnation point of the head of an underwater vehicle 41. The nose of the vehicle is formed into a separate compartment 42 wherein mixing of water and polymer powder occurs, while an aspirator-type midstream ejector 43 is selectively disposed inside the opening of scoop 40. In this embodiment, a pressure vessel 45 which is generally cylindrical in shape is disposed in the aft portion of compartment 42 and contains a carrier liquid 48 and a polymer powder 49 under ambient pressure which is equivalent to the vapor pressure of the carrier liquid. A void 50 is maintained over carrier liquid 48. A supply line 52 originates at the end of cylinder 45 containing polymer powder and terminates in ejector 43 in scoop 40. Selective control of the flow of the combined carrier liquid and polymer powder is provided by a control and metering valve 54. In this embodiment, mixing takes place in chamber 42 in an area aft of scoop 40 and the thoroughly mixed constituents are then forced out of a perforated circumferential band 55 and into a circumferential ring 56 from which the combined material is ejected into the boundary layer through a circumferential slot 57.

There is thus provided by the present invention a method of and means for reducing both the drag and noise of an underwater vehicle by introducing into the boundary layer of the vehicle a combination of polymer and a carrier liquid whereby gas is generated in the vehicle and ejected together with polymer into the boundary layer. The method of polymer mixing for drag reduction alone has been developed to a considerable degree, one example of this being in the patent application of Mr. John Molinski for DRAG REDUCTION METHOD, Ser. No. 12520, filed Jan. 20, 1970. Mr. Molinski's application identifies a plurality of polymers which may be suspended for injection into the boundary layer of a moving aquatic vehicle. Those polymers featured are polymers having a high molecular weight and a long chain which, when ejected with a liquid fluorocarbon carrier in which the polymer is insoluble, creates a suspension of polymer and carrier which appreciably reduces drag on a vehicle. The present invention goes considerably beyond the state of the art as exemplified in Mr. Molinski's application by introducing into the polymer-carrier liquid combination a third compound, i.e., a polyox powder which is acted upon by the carrier liquid and broken down into minute particles. The powder is broken down substantially instantaneously in a proper combination of substances so that separate supplies of powder, polymer and carrier are not necessary. The three substances are combined in a single vessel in a vehicle; and, when mixed in a diffuser, the combination produces a sufficient density of bubbles to effectively decrease the noise of the underwater vehicle. It has been determined in actual tests that a speed increase on the order of 10 knots can be achieved by the proper combination of polymer, carrier and powder. It is possible that the presence of minor bubbles in the ejected flow is a feature in achieving this increase in speed. This result has not been isolated in tests carried out to the present date.

The embodiments herein described and shown for achieving drag and noise reduction have demonstrated a capability for effectively mixing the substances and expelling the polymer solution into the boundary layer, creating a bubble screen or shroud which is entrained in the near wall region and which forms an acoustic barrier or interface. The acoustic barrier serves to attenuate radiated noise emitted from the vehicle. The exact reduction in db has not been precisely determined; however, tests indicate that it is an appreciable reduction and coupled with the increased speed achieved serves to support the effectiveness of the present invention.

Obviously many modifications and variations of the present invention are possible in the light of the above teachings. For example, other liquids or compounds may be discovered which will add to the rapid rate of dissolution of the drag reducing polymers in water, and other forms of ejection apparatus such as spaced orifices in lieu of a circumferential slot may be employed to achieve the results of the present invention.

What is claimed is:

1. A system for reducing the drag and noise of an aquatic vehicle comprising:

a container in said vehicle and a supply of carrier liquid with polymer powder in suspension therein stored in said container;

a passage for admitting water under pressure into said vehicle and means communicating between said container and said passage; said carrier liquid having a sufficient vapor pressure to force the contents of said container into said passage;

means for combining said carrier liquid and said polymer with the water in said passage, said polymer powder pre-wetted by said carrier liquid and adapted to be divided into a substantially infinite number of particles upon mixing with the water under pressure in said passage, with a resultant rapid gas formation;

a chamber in said vehicle and said passage terminating therein; and means for directing the contents of said chamber into the leading portion of the boundary layer of said vehicle, whereby drag and noise are reduced by gas formed in said vehicle and ejected with polymer into said boundary layer.

2. The system as defined in claim 1 wherein said carrier liquid is dichloro, difluoro, methane and said polymer is poly-ethylene-oxide.

3. The system as defined in claim 2 wherein said passage is formed by an intake scoop positioned at the stagnation point of the nose of said vehicle, the water pressure at the inlet of said scoop equivalent to the dynamic head of said vehicle; and a valve in said communicating means for selectively controlling the flow of said suspension from said container into said scoop.

4. The system as defined in claim 3 wherein said scoop is constricted at its throat and said communicating means is a supply line whose outlet is positioned interior of said throat and arranged to direct said suspension axially inwardly in said scoop.

5. The system as defined in claim 4 wherein said chamber is provided with a centrally disposed recess for diffusing said suspension into water entering through said scoop, said scoop terminating a substantial distance inside said recess, said diffusing occurring in a region of lessening pressure wherein said carrier liquid changes phase causing said suspended particles to be further disintegrated;

said container symmetrically disposed about said scoop.

6. The system as defined in claim 4 wherein said chamber occupies a substantial portion of the nose of said vehicle, said container disposed within said chamber, said means for directing the contents of said chamber into the boundary layer of said vehicle including an annular slot in the wall of said vehicle peripherally disposed at the minimum pressure point of the nose of said vehicle.

* * * * *